United States Patent [19]

Midolo

[11] 4,211,093

[45] Jul. 8, 1980

[54] VAPOR CYCLE COOLING SYSTEM

[76] Inventor: Lawrence L. Midolo, 1475 Black Oak Dr., Centerville, Ohio 45459

[21] Appl. No.: 26,865

[22] Filed: Apr. 4, 1979

[51] Int. Cl.[2] ..... F25B 31/00

[52] U.S. Cl. ..... 62/505; 62/510; 62/513

[58] Field of Search ..... 62/117, 505, 510, 513

[56] References Cited

U.S. PATENT DOCUMENTS

| | | | |
|---|---|---|---|
| 3,568,466 | 3/1971 | Brandin et al. | 62/510 |
| 3,808,835 | 5/1974 | Weatherston | 62/510 |

*Primary Examiner*—Ronald C. Capossela
*Attorney, Agent, or Firm*—Joseph E. Rusz; Richard J. Killoren

[57] ABSTRACT

A vapor cycle cooling system having a rotary vane device which provides two stages of compression of the working fluid. The output of an evaporator is supplied to the input of the first compressor stage with the output of the second compressor stage being supplied to a condenser. In one embodiment the output of the condenser is subjected to two stages of expansion with the output of the first expansion stage being supplied to a receiver. The vapor resulting from the first expansion is separated from the saturated liquid in the receiver and is added to the flow between the first and second compressor stages. In a second embodiment the output of an expansion valve in one flow path is used to cool the input of an expansion valve in a second flow path between the condenser and the evaporator.

3 Claims, 2 Drawing Figures

VAPOR CYCLE COOLING SYSTEM

RIGHTS OF THE GOVERNMENT

The invention described herein may be manufactured and used by or for the Government of the United States for all governmental purposes without the payment of any royalty.

BACKGROUND OF THE INVENTION

This invention relates to a vapor cycle cooling system. various air cycle cooling systems using rotary vane compressor-expander apparatus are described in the patents to Edwards, U.S. Pat. No. 3,686,893; 3,913,351; 3,967,466 and 3,977,852. These systems provide a compressor and an expander within the rotor housing to provide cooling.

Various complex compression vapor cycle systems are described on pages 46–74 of "Refrigeration and Air Conditioning" by B. F. Raber et al., published by John Wiley and Sons, Inc., in February 1949. However, no practical complex cycle apparatus is described.

The patent to Weatherston, 3,808,835, describes a cooling system wherein refrigerant vaporized at an intermediate pressure is supplied to closed volume chambers of the compressor.

BRIEF SUMMARY OF THE INVENTION

According to this invention a rotary vane compressor-expander normally used in an air cycle cooling system, as described in the patents to Edwards, is modified to provide a two-stage compressor for a two-phase vapor cycle cooling system. The vaporized refrigerant at an intermediate pressure is supplied to the two stage compressor at a position between the two stages of compression.

IN THE DRAWING

DETAILED DESCRIPTION OF THE INVENTION

Figure 1:
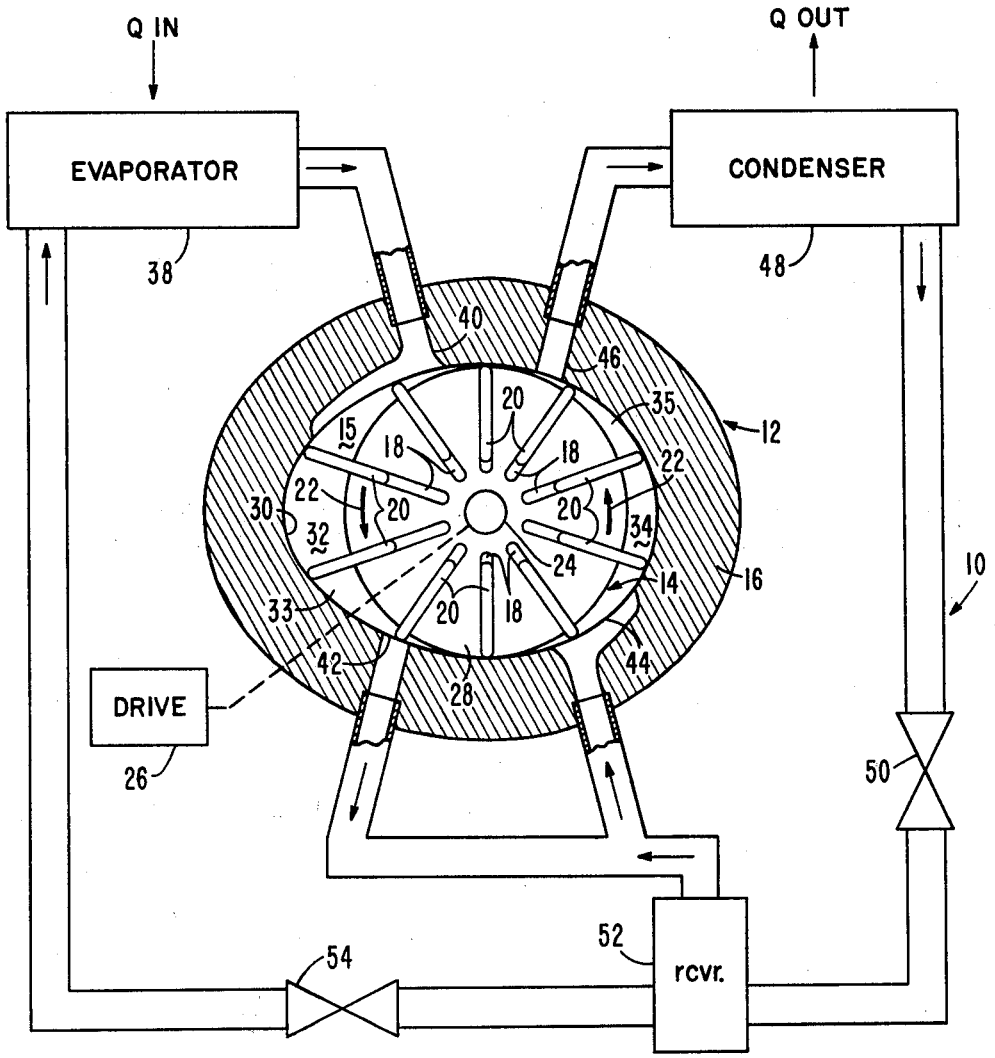
FIG. 1 is a partially schematic diagram of a cooling system according to one embodiment of the invention.

Reference is now made to FIG. 1 of the drawing which shows a vapor-cycle cooling system 10 including a conventional compressor-expander rotary vane device 12, which has been modified to provide a two stage compressor. The rotary vane device 12 includes a rotor 14 within a chamber 15 in housing 16. The rotor has a plurality of radial slots 18 for receiving slidable vanes 20. Any of the prior art blade guide means, not shown, may be provided for the control of vane movement in the slots. The rotor is driven in the direction shown by arrows 22, through shaft 24 by a drive means 26, such as in electric motor or a drive belt driven by the motor of an automobile. As shown in FIG. 1 the rotor body 28 is positioned a greater distance from the chamber wall 30 on the low pressure side 32 of rotor 14 than on the high pressure side 34 of chamber 15. For example, assuming a 2.50 to 1 pressure ratio across each compressor, the spacing of the wall 30 from the rotor on side 32 would be approximately twice the spacing of the wall 30 from the rotor on side 34.

The working fluid used could be a hydrocarbon such as R-12, R-22, or R-114. The working fluid from evaporator 38 is supplied to inlet 40 of the first compressor stage 33 on side 32 of chamber 15; with the output of the first compressor stage being taken off at 42. The output from the first compressor stage is supplied to inlet 44 of the second compressor stage 35 with the output of the second stage being taken off at 46. The output of the second compressor stage is supplied to a condenser 48. The output of condenser 48 is supplied to an expansion valve 50 with the output of the valve 50 being supplied to a receiver 52 wherein the vapor phase coolant is collected and added to the coolant that is supplied to the input 44 of the second compressor stage. The liquid phase coolant from receiver 52 is supplied to a second expansion valve 54, with the output of the second expansion valve 54 being supplied to an evaporator 38.

In the operation of the device of FIG. 1, the output of the evaporator 38 is supplied to inlet 40 of the first compressor stage 33 with the output of the compressor stage being taken off at 42 and fed to the inlet 44 of the second compressor stage 35. Inlets 40 and 44 extend around the periphery of chamber 15 in the regions of normal expansion of the volume between adjacent vanes 20. The output of the second compressor stage 35 is supplied to condenser 48 wherein heat is removed in a conventional manner. The output of condenser is supplied to two stages of expansion in valves 50 and 54. Vapor produced in the first expansion is separated in receiver 52 and added to the flow between outlet 42 and inlet 44 wherein it provides a small amount of cooling for the flow between the compressor stages. After the liquid coolant from receiver 52 undergoes the second expansion it is supplied to evaporator 38 where it absorbs heat in a conventional manner.

Figure 2:
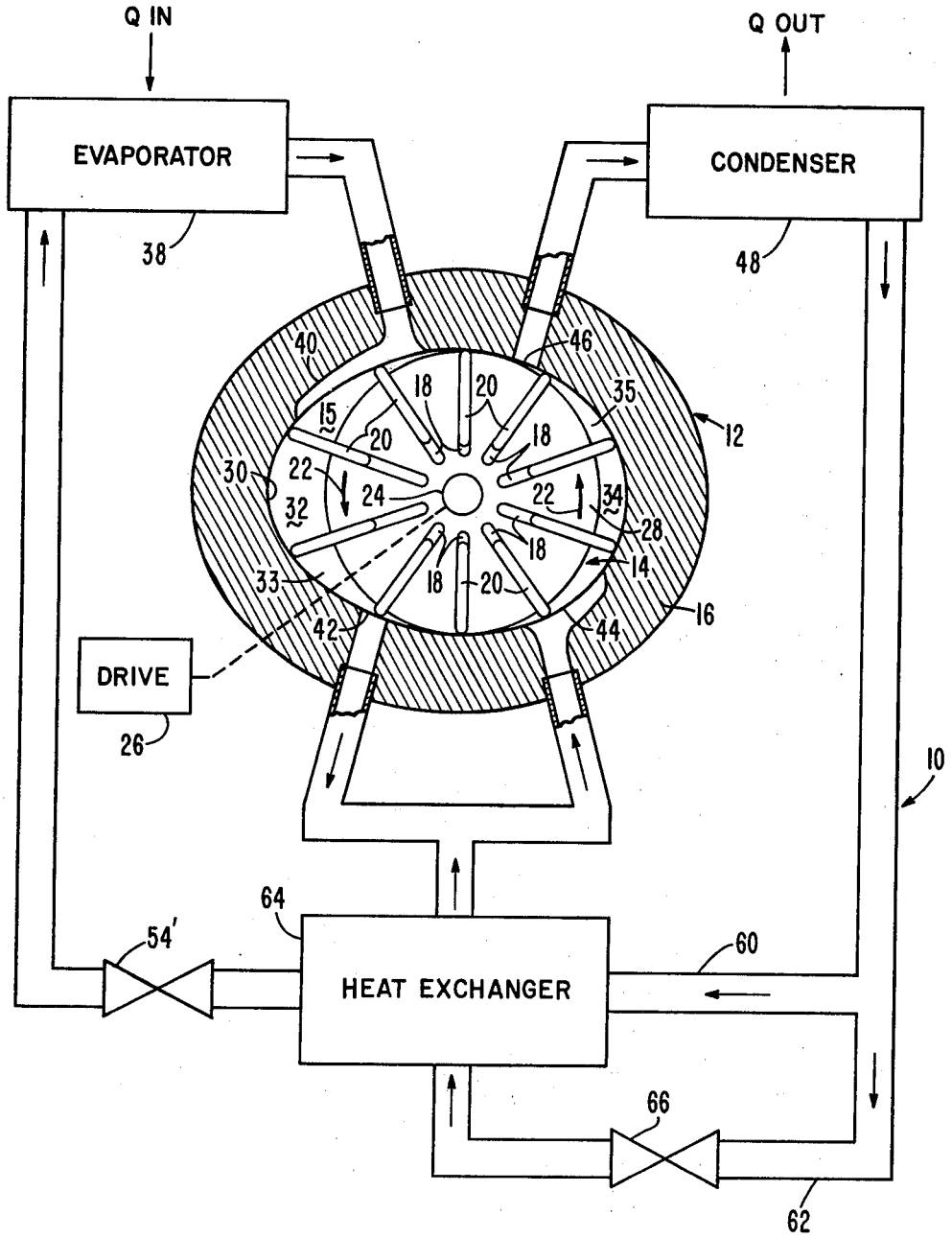
FIG. 2 is a partially schematic diagram of an another embodiment of the invention.

A device for providing a higher coefficient of performance than the device of FIG. 1 is shown in FIG. 2. In the device of FIG. 2 the rotary vane device 12 operates in the same manner as in FIG. 1 but the output of the condenser 48 is divided into two flow paths 60 and 62. The flow in path 60 passes through heat exchanger 64 to an expansion valve 54'. The flow in path 62 passes through an expansion valve 66 which lowers the temperature of the coolant after which the coolant in flow path 62 is supplied to heat exchanger 64 wherein it removes heat from the flow in flow path 60. The lower temperature coolant flowing through expansion valve 54' provides increased cooling in evaporator 38. The device of FIG. 2 otherwise operates in a similar manner to the device of FIG. 1.

There is thus provided an apparatus which makes use of a rotary vane device as a two stage compressor in a two phase cooling system, which provides a higher coefficient of performance than prior art devices.

I claim:

1. A rotary vane cooling system including a two phase coolant, comprising: a vaporizable liquid working medium within said cooling system; an evaporator having an inlet and an outlet; a condenser having an inlet and an outlet; a two stage rotary vane compressor, including means for connecting the outlet of a first compressor stage to the inlet of a second compressor stage; said two stage rotary vane compressor being connected between the outlet of said evaporator and the inlet at said condenser; an expansion device connected between the outlet of said condenser and the inlet of said evaporator; said two stage compressor including a housing having a chamber therein, a rotor on a rotatable shaft; said rotor being positioned within said chamber; said rotor having a plurality of slidable vanes which form a plurality of cells, within said chamber, which change in volume as the rotor rotates; said plurality of cells including a plurality of cells on one side of said rotor which corresponds to said first compressor stage and a plurality of cells on the other side of said rotor which corresponds to said second compressor stage; said cells corresponding to said first compressor stage having a greater maximum volume than the cells corresponding to said second compressor stage; and means for supplying at least a portion of the vapor resulting from the expansion in said expansion device to the inlet of the second compressor stage for providing cooling in the inlet of said second compressor stage.

2. The device as recited in claim 1 wherein said expansion device includes a first expansion valve and a second expansion valve; said means for supplying at least a portion of the vapor resulting from said expansion to the inlet of the second compressor stage includes a receiver connected between said first expansion valve and said second expansion valve and means for supplying vapor collected in said receiver to the inlet of the second stage of said compressor.

3. The device as recited in claim 1 wherein said expansion device includes a first expansion valve with an inlet connected to said condenser and an outlet connected to said evaporator; a second expansion valve with an inlet connected to said condenser and an outlet connected to the inlet of the second compressor stage; a heat exchanger including a first flow path connected between the outlet of said condenser and the inlet of said first expansion valve and a second flow path connected between the outlet of said second expansion valve and the inlet of the second stage of said compressor.

* * * * *